US008458923B2

(12) United States Patent
Mackinnon et al.

(10) Patent No.: US 8,458,923 B2
(45) Date of Patent: Jun. 11, 2013

(54) PORTABLE ULTRAVIOLET FLOOR CURING DEVICE

(75) Inventors: Andrew J. Mackinnon, Garden Grove, CA (US); Dick Amen, Westminster, CA (US)

(73) Assignee: Jelight Company, Inc., Irvine, CA (US)

( * ) Notice: Subject to any disclaimer, the term of this patent is extended or adjusted under 35 U.S.C. 154(b) by 248 days.

(21) Appl. No.: 12/932,137

(22) Filed: Feb. 17, 2011

(65) Prior Publication Data

US 2012/0210593 A1 Aug. 23, 2012

(51) Int. Cl.
*F26B 3/34* (2006.01)

(52) U.S. Cl.
USPC ..... 34/277; 34/204; 34/206; 427/163.2; 427/493; 427/508; 118/620; 118/643; 250/504 R; 252/8.61; 528/28

(58) Field of Classification Search
CPC ..... F26B 3/34
USPC ..... 34/277, 204, 206, 209, 210, 211, 34/236; 528/28; 156/166, 285, 212, 382; 427/407.1, 493, 163.2, 508, 512, 514; 252/8.61; 118/125, 620, 641, 642, 643; 250/504 R, 504, 492.1
See application file for complete search history.

(56) References Cited

U.S. PATENT DOCUMENTS

| | | | | |
|---|---|---|---|---|
| 4,999,216 | A * | 3/1991 | Gaske et al. | 427/519 |
| 5,833,796 | A * | 11/1998 | Matich | 156/285 |
| 6,096,383 | A * | 8/2000 | Berg et al. | 427/493 |
| 6,468,350 | B1 * | 10/2002 | Hillenbrand | 118/620 |
| 6,538,258 | B1 * | 3/2003 | Rau et al. | 250/504 R |
| 6,761,127 | B2 * | 7/2004 | Field et al. | 118/620 |
| 6,764,719 | B2 * | 7/2004 | Russell et al. | 427/393.5 |
| 6,794,001 | B2 * | 9/2004 | Chen et al. | 428/40.1 |
| 8,277,138 | B2 * | 10/2012 | Wakalopulos | 401/270 |
| 2004/0094727 | A1 * | 5/2004 | Holmes | 250/504 R |
| 2004/0239243 | A1 * | 12/2004 | Roberts et al. | 313/512 |
| 2009/0044897 | A1 * | 2/2009 | Thomsen et al. | 156/150 |
| 2009/0271933 | A1 * | 11/2009 | Shah et al. | 8/562 |
| 2012/0009351 | A1 * | 1/2012 | MacKinnon et al. | 427/487 |
| 2012/0066987 | A1 * | 3/2012 | Malofsky et al. | 52/173.1 |
| 2012/0210593 | A1 * | 8/2012 | Mackinnon et al. | 34/277 |

FOREIGN PATENT DOCUMENTS

| | | | |
|---|---|---|---|
| DE | 10260998 | A1 * | 7/2004 |
| EP | 1072659 | A1 * | 1/2001 |
| JP | 06134381 | A * | 5/1994 |
| JP | 2001121552 | A * | 5/2001 |
| JP | 2002336759 | A * | 11/2002 |
| JP | 2009273960 | A * | 11/2009 |

* cited by examiner

*Primary Examiner* — Steve M Gravini
(74) *Attorney, Agent, or Firm* — Smyrski Law Group, A P.C.

(57) ABSTRACT

A floor curing apparatus is disclosed, including an ultraviolet lamp, a replaceable reflector configured to direct light energy transmitted from the ultraviolet lamp, the replaceable reflector including one of a plurality of interchangeable reflectors, a shutter mechanism configured to selectively move a shutter to expose the ultraviolet lamp and the reflector toward a surface upon which the floor curing apparatus operates, and wheels. The ultraviolet lamp and the reflector height from the floor surface are maintained at a predetermined distance above the surface. The plurality of interchangeable reflectors provides varying transmission characteristics.

18 Claims, 11 Drawing Sheets

PORTABLE ULTRAVIOLET FLOOR CURING DEVICE

BACKGROUND OF THE INVENTION

1. Field of the Invention

The present invention relates generally to the art of curing ultraviolet sealant material on floors, and more specifically a portable apparatus for enhanced curing of sealant to floor surfaces using ultraviolet radiation.

2. Description of the Related Art

Various types of flooring materials are available for use in industrial, manufacturing, and warehouse applications. Certain surfaces can be cured using a photo-initiated or photosensitive sealant material. For example, an ultraviolet (UV) 'sealer' is applied to the floor surface to protect the surface from wear and tear due to foot traffic, motorized traffic, spills, and so forth. For certain floor types, it may be highly desirable to apply UV sealers specially formulated for hardwood, stone, tile, medium density fiberboard, particle board, plywood, vinyl materials, or concrete flooring.

For example, to seal concrete floors a urethane-based copolymer UV material may be applied to the concrete floor surface, and cured. Other floor material types may respond well to treatment with photo-initiated sealant materials including acrylated and cationic epoxies, urethanes, polyesters, and environmental protection agency zero volatile organic compound formulas.

Many of today's UV sealant material formulations require a long period of time, e.g. ranging from several hours to days, to fully cure a surface such that the surface is ready for use. In situations where the area being sealed incurs a great deal of traffic or provides an emergency exit pathway, extensive down time while the sealant is curing is highly undesirable.

Various devices are currently available to facilitate the curing and sealing of UV light sensitive coatings applied to a floor surface. In general, such curing machines include a UV lamp, a reflector, and a power source housed in a moveable and portable frame. The device is positioned over the floor surface whereupon radiation provided from the UV lamp is directed to the coated surface. The frame may be manually pushed across the floor surface, and in certain instances, mechanized wheels power and propel the frame forward. Such machines typically power a UV light source at a relatively small distance above the surface, from a few inches to a foot, whereby adjusting the height of the frame away from the surface can in certain instances reduce the UV radiation applied to the coating. Materials requiring significant radiation for curing may require operation of such a machine and light source a very small distance from the floor to adequately cure, the surface.

Today's designs may be problematic when operated in small spaces, in cramped quarters, and/or used for smaller jobs. Previous large designs may be unwieldy in such situations.

Typical existing curing designs employ a large width irradiator component sufficient for efficient operation on large surfaces, such as a warehouse floor. Large curing machines may become problematic when operated in smaller areas such as sealing wood flooring in a home, vinyl flooring in a hospital room or ward, and/or when operated in other facilities including gyms, restaurants. Large machines may be limited or prevent sideways movement and can be problematic when curing floor surfaces that border another structure, such as an orthogonal interior wall and installed equipment, as well as flooring surface edges, such as formed by a 'T-mold' transition strip positioned between the surface ready for curing and a carpeted, laminated, tiled, or other separated areas.

Additionally, today's floor curing systems large machine size may become problematic and difficult to move from one project site to the next project site, and store when not in use particularly in small places due to limited space constraints. Deploying a large machine to complete a job having a small physical area or may not be cost feasible or may significantly reduce profitability.

Further, certain existing designs employ a single universal UV source which may be undesirable in different situations, such as when curing different materials. A UV source that works well on one sealant/surface may not work well on another sealant/surface combination. The ability to cure all types of sealants in all types of scenarios can be particularly beneficial, where an appropriate amount of curing energy can be provided to the surface.

It would therefore be useful to provide a floor curing machine design that overcomes the drawbacks associated with previous machines.

SUMMARY OF THE INVENTION

According to one aspect of the present design, there is provided a portable floor curing apparatus, including an ultraviolet lamp, a replaceable reflector configured to direct light energy transmitted from the ultraviolet lamp, the replaceable reflector including one of a plurality of interchangeable reflectors, a shutter mechanism configured to selectively move a shutter to expose the ultraviolet lamp and the reflector toward a surface upon which the floor curing apparatus operates, and wheels. The ultraviolet lamp and the reflector height from the floor surface are maintained at a predetermined distance above the surface. The plurality of interchangeable reflectors provides varying transmission characteristics.

Other attributes of the portable design are disclosed, including a telescoping handle and specific wheel configurations.

These and other advantages of the present invention will become apparent to those skilled in the art from the following detailed description of the invention and the accompanying drawings.

DESCRIPTION OF THE DRAWINGS

The present invention is illustrated by way of example, and not by way of limitation, in the figures of the accompanying drawings in which.

DETAILED DESCRIPTION OF THE INVENTION

Figure 1B:
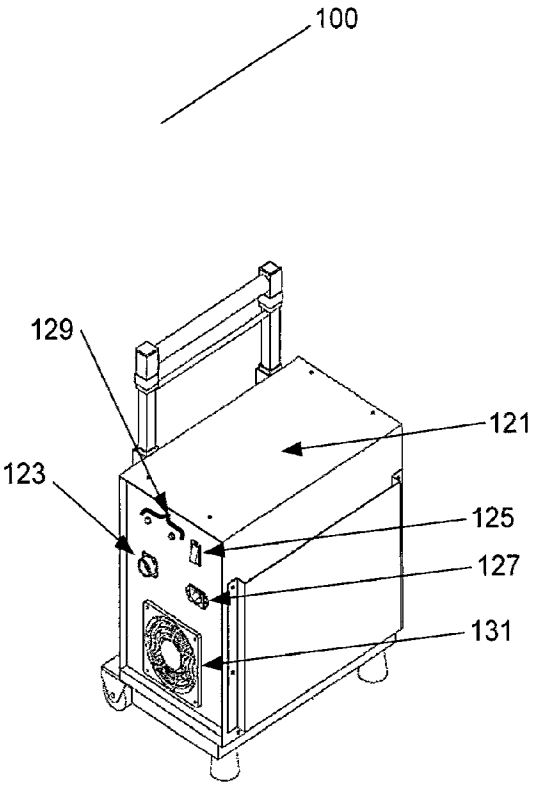
FIG. 1B is a front side perspective view illustrating a power supply module.

The present design is a portable floor curing apparatus comprising an irradiator assembly, reflector assembly, shutter assembly, cooling fans, in combination with a power supply module and a control console component. The assemblies, components, and devices are affixed to a wheel driven frame where the wheels are typically employed over a smooth surface, e.g. hardwood, stone, tile, and vinyl materials or concrete floor, where the surface has been treated with photo-initiated material. The rear wheels are a freewheeling omnidirectional design configured to facilitate movement of the floor curing machine when operated along side or against a wall, surface edge, or room transitions while operating at a relatively constant speed.

Additionally, the wheel driven frame is a fixed configuration where the vertical height of the ultraviolet irradiator, i.e. lamp, maintains a constant distance between the ultraviolet lamp and the floor surface at all times. A generally similar type of floor curing device is disclosed in U.S. patent application Ser. No. 12/803,985, entitled "Ultraviolet Floor Curing Device," filed Jul. 12, 2010, inventors Andrew J. Mackinnon, et al, the entirety of which is incorporated herein by reference.

The present design includes an assembly that permits use of various reflectors, and the reflectors offered may include a focused reflector profile, a "flood light effect" reflector, and a cross focused reflector providing two focus points. Each reflector may be manually installed and each reflector may be employed to address specific surfaces and sealants. In the present design, curing energy is maintained via the use of this interchangeable reflector design.

The wheel driven frame may allow a user to move the entire apparatus back and forth or in a turning motion during general use. The user may operate the present design using a pistol handle grip with a trigger switch located on a handlebar portion of the irradiator control panel.

During operation the user may control the direction of the machine by applying equal and uniform force or pressure on the handgrip to engage both rear wheels equally and move the apparatus in a straightforward direction. Applying unequal force or pressure across the handgrip by means of applying either a left or right force to the handgrip may allow the machine to rotate about either the left side or right side freewheeling omnidirectional rear wheel, allowing one rear wheel to rotate around the opposite rear wheel. For example, applying pressure at the handgrip may direct the apparatus to the left. A left turn is realized by allowing the right side rear wheel to travel in an amount further than the left side rear wheel and allow the frame's right side rear wheel to rotate faster than the left side wheels affording the right side wheels the ability to travel a further distance when executing a left hand turn, preventing scuffing of the floor surface due to potential wheel drag.

The present freewheeling omnidirectional rear wheel arrangement enables the machine to change direction while maintaining a forward direction by allowing the machine to rotate in response to operator input from the handgrip. The operator may apply a force at the handgrip to direct the apparatus left or right.

The user may select the level of ultraviolet output power desired. The user may use the trigger switch to direct the opening and closing of a shutter device provided on the bottom of the portable floor curing device.

The shutter device enables control of the energy or radiation exposure or dose delivered to the flooring surface from the irradiation source, e.g. mercury ultraviolet light. The shutter device may include a linear actuator, such as a piston arrangement, configured to open and close the shutter based on input from the user selected at the control console.

When curing a particular type of floor coating material, such as urethane-based copolymers applied at a particular thickness and on top of a flooring material type, such as concrete, the operator may push the device at a speed of, for example, forty feet per minute. The operator may select a flood projection pattern reflector profile and a low electrical power output using a switch on the control console, causing a ultraviolet output power reduction on the order of 30 to 60 percent of full power depending on machine configuration. Such selectability enables control over the amount of emitted ultraviolet radiation usable to cure the applied photosensitive coating material.

Electronic controls receiving operator input and directing the components of the device in the manner desired are provided. For example, if X watts of ultraviolet radiation are desired, setting the controls to X watts may be an electronic setting or mechanical setting available to the user, and appropriate power may be provided to the ultraviolet light to effectuate the desired power level. Similarly, retraction timing for the shutter and other values or functions may be set and effectuated using control circuitry.

The operator may adjust the handgrip height via a telescoping device by lengthening or shortening the telescoping device. For example, a first handlebar position may facilitate user control while curing step surfaces under a staircase, and a second position may facilitate storage and transportation. Longer lengths may afford multiple convenient handlebar positions during operation on a long flat surface.

System

Figure 1A:
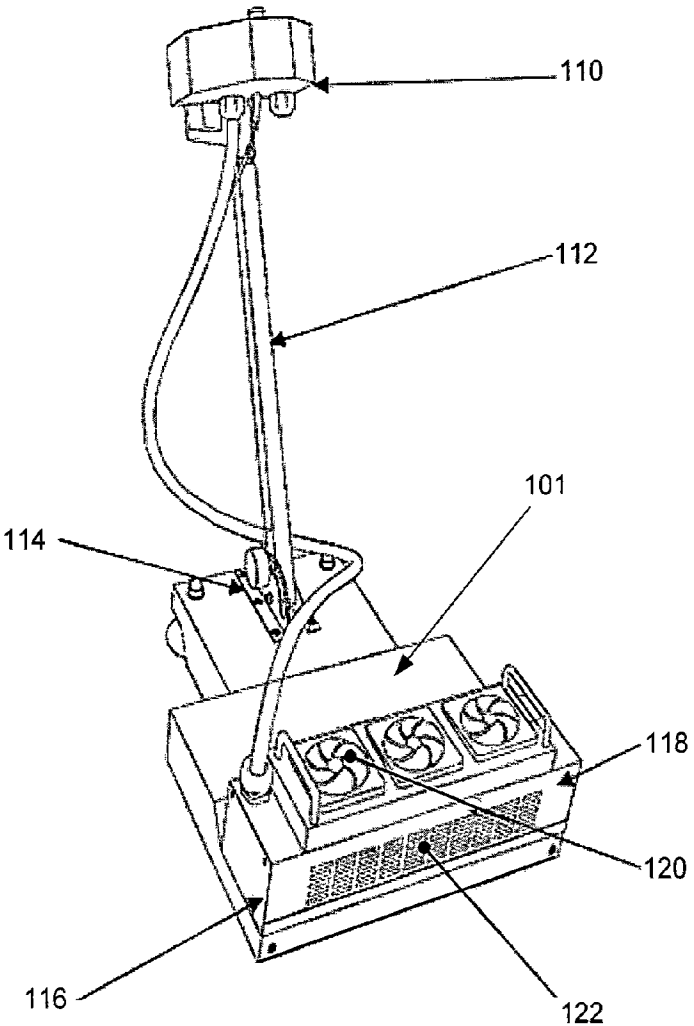
FIG. 1A is a front side perspective view illustrating an irradiator module.

One embodiment of the floor curing apparatus is illustrated in FIGS. 1A and 1B. In combination, these representations graphically depict relationships between major assemblies and subassemblies, e.g. modules, components, and devices, for an embodiment of the present design. FIG. 1A is a front side perspective view illustrating an irradiator assembly and FIG. 1B is a front side perspective view illustrating a power supply module in accordance with the present design. The irradiator assembly and power supply module, in combination, provide for floor curing apparatus 100 in accordance with the present design.

Referring to FIG. 1A, irradiator assembly 101 may include a control console component 110, telescoping handlebar 112 with angle adjustment knob 114, irradiator assembly 116 arrangement including an ultraviolet lamp housing 118, irradiator fans 120, and exhaust vents 122 components. Irradiator assembly 101 is typically positioned over photo-initiated floor coating applied to smooth floor surface, e.g. hardwood, stone, tile, and vinyl materials, or a concrete floor.

Referring to FIG. 1B, power supply module 121 may include an output receptacle 123 providing a connection for attachment to the irradiator assembly. The power supply module may include a power on/off switch 125, an input cord receptacle 127 providing a connection for attachment to the electrical wall outlet, e.g. 120 volt 15 amp service, circuit breaker reset buttons at 129, and cooling fan 131 components. The irradiator assembly, power supply module, and interconnecting cable arrangement allow for easily moving the floor curing apparatus by a single operator during operation.

Shutter Assembly

Figure 2:
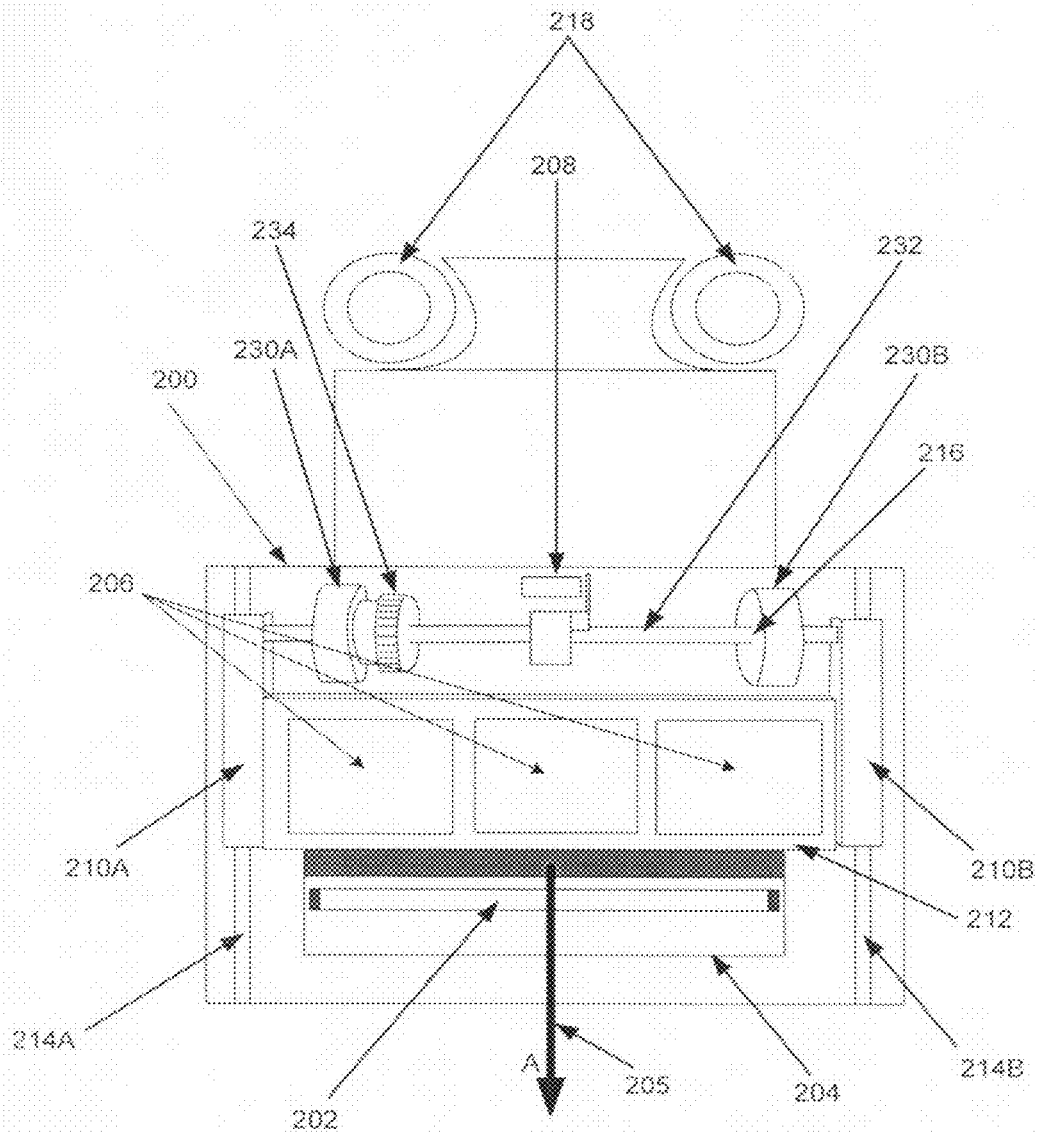
FIG. 2 is a bottom view illustrating a shutter mechanism.

FIG. 2 illustrates a bottom view of the modules, components, and devices in a shutter mechanism assembly embodiment. The front of the apparatus is facing downward in FIG. 2. The shutter assembly may be a subassembly of the FIG. 1A irradiator assembly in accordance with one aspect of the present design.

Irradiator frame assembly 200 may include a low-pressure mercury ultraviolet lamp component 202 configured with reflector assembly 204. The cooling fans, shown in FIG. 1A, may force air downward toward the top, or non-reflective side, of the reflector assembly. Forced air heated by the ultraviolet lamp may exit the irradiator frame through vents positioned at the front and rear faces of the irradiator assembly.

The irradiation frame may include a skirt (not shown) configured to maintain the irradiator emissions inside irradiator frame 200. The skirt may extend around all sides of irradiator frame 200 forming an enclosure sufficient for containing the ultraviolet emissions between the apparatus and the floor surface. The skirt arrangement may also prevent ultraviolet exposure to the operator and restrict spurious emission of radiated energy.

The shutter assembly in FIG. 2 is shown in the open/retracted position, allowing ultraviolet lamp 202 to be exposed. The shutter assembly may involve a linear actuator underneath the bottom cover at point 208, to open and close the shutter. The shutter assembly may include two polytetrafluoroethylene (PTFE) guide blocks, one is positioned at each side of the assembly, where the guide blocks are arranged to slide back and forth on ceramic-coated shafts. The linear actuator may extend and retract axle 232 and the pair of guide blocks, where left guide block 210A and right guide block 210B facilitate opening and closing shutter 212. The guide blocks may be supported by a left shaft 214A and right shaft 214B and may form a rigid support in combination with the rear shutter bar. In one embodiment, as the shutter closes, in the direction shown by arrow 'A' 205, the present design may include moving the front wheels and axle assembly 216 forward to provide extra stability when the machine is not in use. Shutter louvers 206 are provided and are retracted with the shutter.

In operation, the shutter assembly of FIG. 2 is originally oriented with shutter 212 obscuring ultraviolet lamp 202. The floor curing apparatus may include controls and electronics to actuate the linear actuator. In one arrangement, the controls may be engaged by the operator and the shutter assembly opening sequence may be initiated, while in another arrangement the device may use a timer to determine that ultraviolet lamp 202 has been operating for a predetermined amount of time sufficient to "warm up" the device, whereupon the device is ready for use and the shutter assembly opening sequence initiated.

Once the shutter assembly is activated, the device provides a signal to actuate the piston in the linear actuator, which drives the piston in the linear actuator to apply a force to the axle 232. Force applied to axle 232 drives the axle 232 toward the back of the apparatus in the bottom side orientation shown, causing left guide block 210A and right guide block 210B to travel across left shaft 214A and right shaft 214B thus pulling or drawing shutter 212 away from the ultraviolet lamp 202. Such operation enables ultraviolet radiation application at a desired time with relatively minimal risk of fouling or contacting other parts of the machine or the floor. Note that some type of lubricant, such as high temperature grease, may be applied to left guide shaft 214A and right guide shaft 214B. Simple periodic maintenance can ensure relatively high efficiency performance of the present design.

While in the design discussed herein does not use drive wheels or a drive system, such a system may be employed if desired. The floor curing apparatus may involve a gear motor (not shown) and a clutch (not shown) connected by a drive chain (not shown) for powering axle assembly 216 to rotate the drive wheels. The axle assembly may connect gear sprocket 234, fixed to linear driveshaft 232, with a gear sprocket fixed to the gear motor. Transfer of rotational motion from the gear motor to the drive wheels may propel the floor curing apparatus in a forward direction when the clutch is engaged. When operating the floor curing apparatus, the user may engage a clutch to rotate and spin axle assembly 216 relative to the gear motor speed using, for example, a pistol handle grip and trigger such as is illustrated in FIG. 8.

The floor curing apparatus may provide a pair of swivel ball caster wheels 218 at the rear of the apparatus. The wheels and swivel ball caster wheels are the only apparatus components that are desired to come in contact the coated floor surface. Ball caster wheels 218 may be positioned at a similar location in line with the front wheels, with respect to the center of the apparatus, in the manner shown. Two ball caster wheels are shown in this embodiment, but more may be employed.

Arranging front wheels with rear freewheeling ball caster wheels may enable floor curing apparatus 100, shown in FIG. 1, to smoothly make various left and right directional changes while still maintaining a forward direction and be easily be maneuvered against a wall, a piece of large furniture or office machinery, or other object defining an edge, and to negotiate tight spaces without the apparatus making contact with the floor coating material.

Reflector

The irradiator, enclosed in irradiator frame 200, may be situated at a fixed height in relation to the floor surface. In this fixed height configuration, the operator may control the amount of ultraviolet exposure realized from the floor curing apparatus by installing reflector assemblies with differing illumination or projection patterns. Selecting from a set of reflector assemblies, each exhibiting a predetermined focus pattern, can provide for varying amounts of energy delivery in accordance with the operator's desired ultraviolet dosing characteristics. The operator may consider certain energy delivery parameters to determine the actual dosing characteristics required for a particular project. For example, the type of sealant, type of floor surface material, thickness of the applied sealant, desired cure speed, and environmental conditions, such as humidity, all may influence the operator's choice of reflector focus pattern.

The operator may adjust the amount of radiated ultraviolet energy absorbed by photosensitive floor coating by selecting and installing a particular reflector, and may further refine the adjusted amount using control console component 110, shown in FIG. 1A, i.e. adjusting functions such as power output. By adjusting the irradiator exposure pattern delivered to floor sealant applied atop of the floor surface and the rate of travel, the operator may control the amount ultraviolet emission necessary to rapidly cure the photo-initiated floor coating.

The present design's combination of a predetermined or fixed pattern reflector in conjunction with a fixed ultraviolet lamp height, in relation to the floor surface, may provide some control of the amount of ultraviolet radiation provided to cure the sealant material applied atop the floor surface. Fixing the height adjustment in this manner may reduce the curing energy losses sufficient for efficient and rapid curing of photo-initiated coatings and may prevent the apparatus skirt and other lower machine components from touching the floor coating material and floor during operation.

Figures 3A, 3B, 3C:
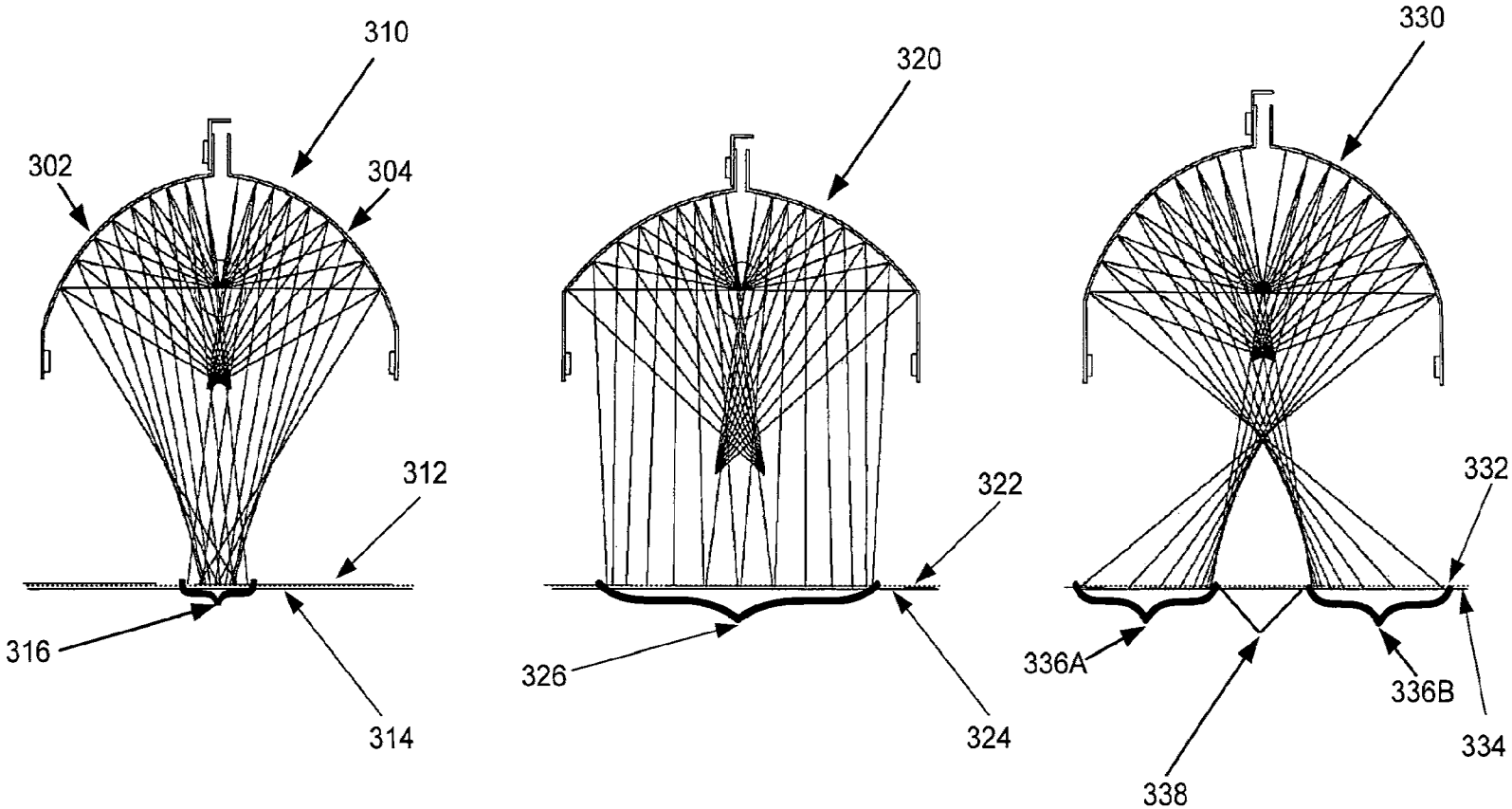
FIG. 3A illustrates a reflector configured for delivering a 'focused' pattern of ultraviolet light energy on a surface.
FIG. 3B illustrates a reflector configured for delivering a 'flood' pattern of ultraviolet light energy on a surface.
FIG. 3C illustrates a reflector configured for delivering a 'cross-focused' pattern of ultraviolet light energy on a surface.

The present design may include selecting from a plurality of reflector profiles for adjusting the ultraviolet dosage delivered during operation. Referring to FIGS. 3A-3C, the floor curing apparatus may direct ultraviolet energy toward the floor coating involving a two part elliptical reflector. For example, the reflector embodiment shown in FIG. 3A includes front elliptical reflector 302 in combination with rear elliptical reflector 304 to focus the ultraviolet energy as shown emitted from the ultraviolet lamp. This combination of direct and reflected energy can provide an efficient means for rapidly curing floor coatings.

The reflector profiles for adjusting the ultraviolet dosage may include but are not limited to a focused projection pattern shown in FIG. 3A, a flood projection pattern shown in FIG. 3B, and a cross-focused projection pattern shown in FIG. 3C for directing ultraviolet energy toward the applied sealant. The focused projection pattern reflector 310 illustrated in FIG. 3A may concentrate the exposed ultraviolet light toward the photosensitive floor coating 312 applied atop of smooth floor surface 314 over narrow swath width 316. The flood projection pattern reflector 320 illustrated in FIG. 3B may distribute the exposed ultraviolet light directed toward floor coating 322 applied atop of floor surface 324 equally over wide track width 326. The cross-focused projection pattern reflector 330 illustrated in FIG. 3C may distribute the exposed ultraviolet light directed toward floor coating 332 applied atop of floor surface 334 equally toward left focal point 336A and right focal point 336B and forming a null at point 338, or reduced exposure, centered between the left and right focal points as shown. The present design projection patterns are not limited to the embodiments illustrated in FIG. 3, and in certain instances a parabolic reflector or reflective surface may be employed to vary energy patterns.

Spur Gear

The present designs speed readout assembly may involve the use of a spur gear for determining the speed of the floor-curing machine. FIG. 4 illustrates the interaction and orientation for a spur gear and a magnetic sensor, fixed to the irradiator frame, where the sensor may generate a signal when the floor curing apparatus is in operational use and the gear is rotated. The spur gear may attach to a front wheel and caused to rotate when the apparatus is in use and propelled in the forward direction.

Figure 4B:
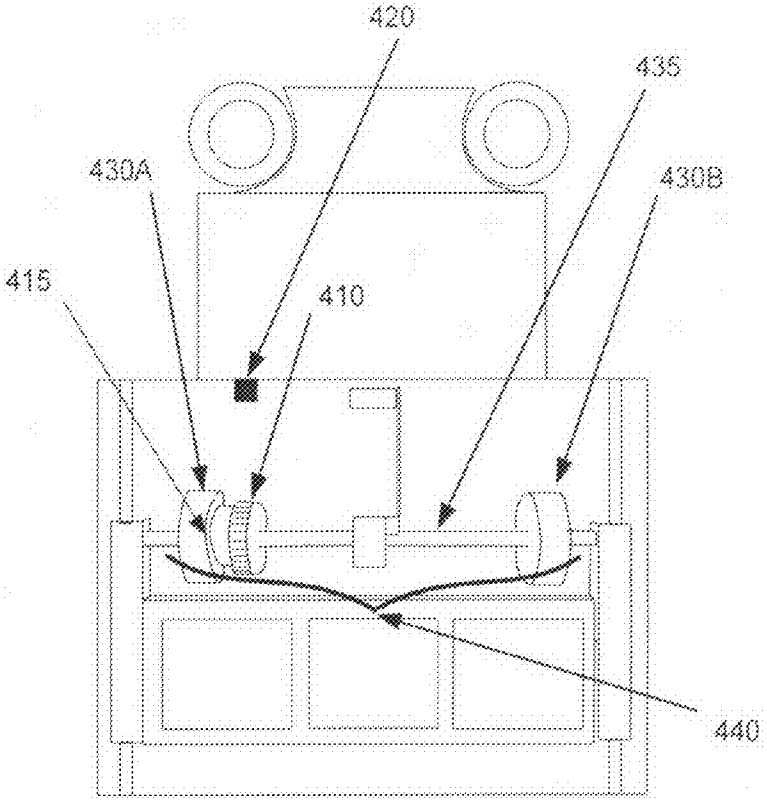
FIG. 4B is a spur gear and a magnetic sensor positioned away from the spur gear when the shutter is closed.
Figure 4A:
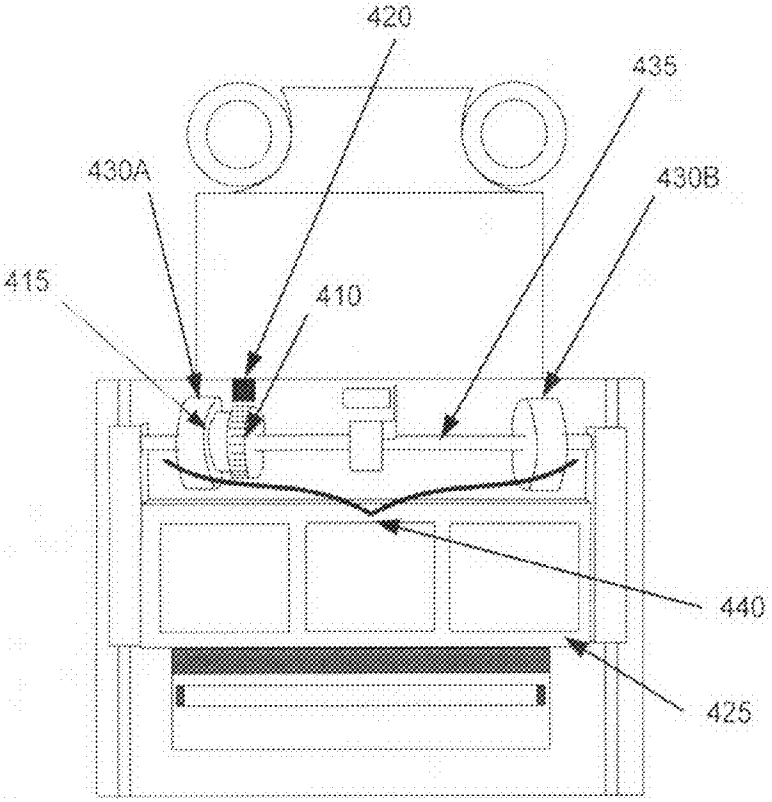
FIG. 4A shows a spur gear and a magnetic sensor positioned in close proximity with the spur gear when the shutter is open.

FIG. 4A illustrates the spur gear and the magnetic sensor positioned when the shutter is open. FIG. 4B illustrates the spur gear and the magnetic sensor positioned when the shutter is closed.

FIG. 4A illustrates a spur gear and a magnetic sensor positioned in close proximity with the spur gear when the shutter is open. Spur gear 410 may attach to a wheel at point 415, where sensor 420, such as a magnetic pickup device, may detect the rotating spur gear teeth. When the linear actuator operates to open shutter 425, the present design may involve moving axle assembly 440, including left wheel 430A and right wheel 430B, linear drive shaft 435, spur gear 410 and other elements supported by the left and right guide block and their associated ceramic shafts (refer to FIG. 2) toward the rear of the irradiator frame while simultaneously opening shutter 425. As the shutter is opened, axle assembly 440 is moved within close proximity to sensor 420 sufficient for detecting and monitoring the progression of the spur gear teeth as they pass by the sensor when the wheel and gear combination is rotated.

The magnetic sensor may transmit a pulse signal to the control console component every time a gear tooth passes the sensor. The control console may include a digital display device and may be programmed to count pulses generated from the progression of the rotating gear teeth, counted over a period of time, sufficient for determining the machine speed and distance traveled as the wheel turns and rotates the teeth past the sensor. The digital display device may provide a liquid crystal or light emitting diode display available for viewing the real time machine speed by the operator presented on the control console at the top of the machine.

FIG. 4B illustrates a spur gear and a magnetic sensor positioned away from the spur gear when the shutter is closed. When the linear actuator operates to close the shutter, the present design may involve moving axle assembly 440, including left wheel 430A and right wheel 430B, shaft 435, spur gear 410, and other elements supported by the left and right guide block and their associated ceramic-coated shafts (refer to FIG. 2) away from the rear of the irradiator frame while simultaneously closing the shutter. As the shutter closes, the axle assembly is moved away from the sensor sufficient for the sensor to be unable to detect the presence of the spur gear teeth.

In an optional drive wheel embodiment, each wheel may connect to linear driveshaft 435 via a clutch bearing (not shown). The clutch bearing may be used in conjunction with a drive system to drive the wheels at slightly different speeds by causing slipping when executing a turn.

Caster Wheel

Figure 5A:
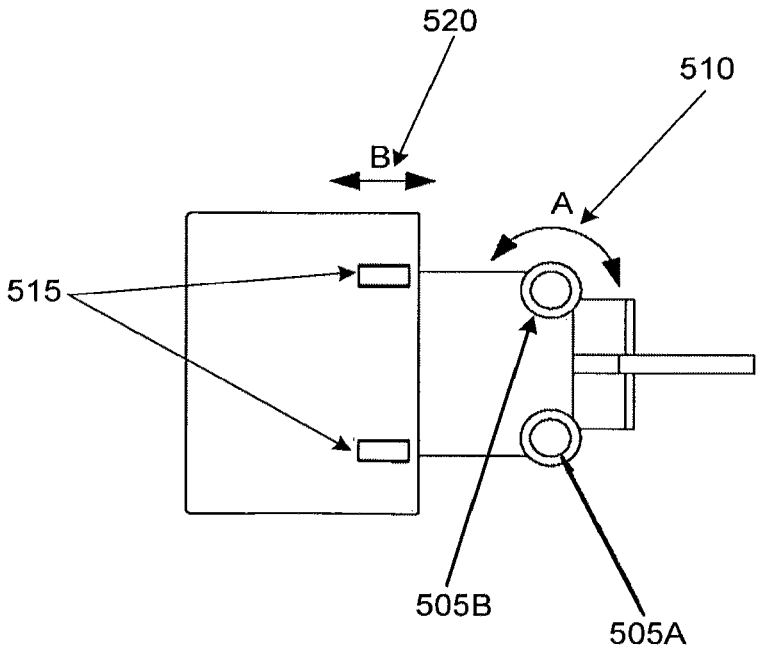
FIG. 5A is a bottom view illustrating a rear caster wheel arrangement.

The present design may include a pair of ball casters or ball caster wheels at the rear of the irradiator assembly. FIG. 5A is a bottom view illustrating a rear ball caster wheel arrangement in accordance with one aspect of the present design. Right ball caster rear wheel 505A and left ball caster rear wheel 505B may facilitate sideways movement by rotating or pivoting about either rear wheel indicated by arrow 'A' at point 510. The combination of front wheels 515, configured for movement in a straight line indicated by arrow 'B' at point 520, and the rear ball caster wheels may allow for steering the apparatus left or right and may provide for sideways movement. In this configuration, the apparatus may enable the floor curing apparatus to operate smoothly when curing sealant along wall edges.

Figures 5B, 5C:
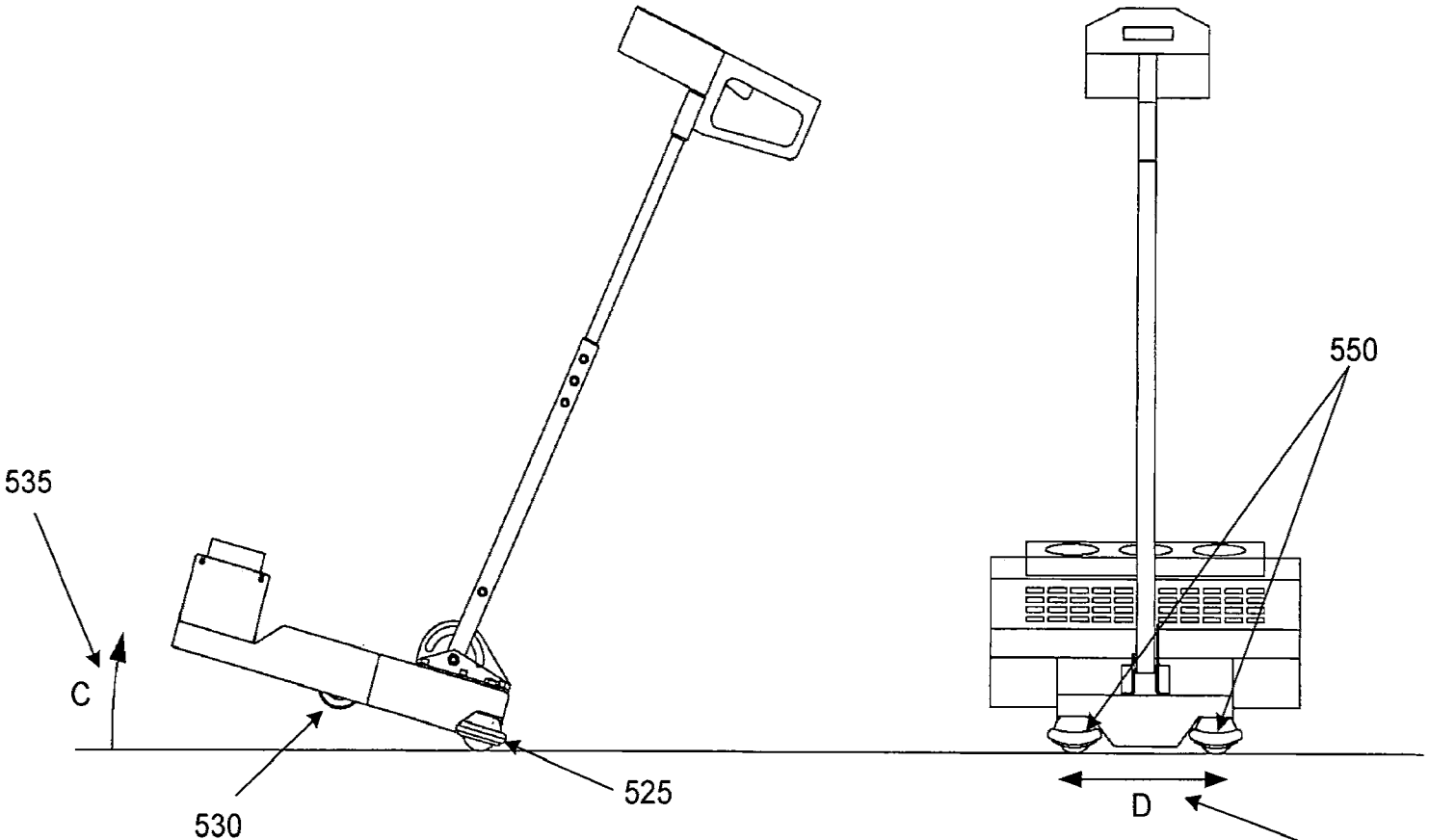
FIG. 5B is a side view illustrating an irradiator assembly rotating about a horizontal axis on the rear caster wheel arrangement.
FIG. 5C illustrates a rear side view illustrating the rear caster wheel arrangement.

FIG. 5B is a side view illustrating an irradiator assembly rotating about a horizontal axis on the rear caster wheel arrangement accordance with one aspect of the present design. In addition to sideways movements, rear ball caster wheels 525 may allow the operator to tilt or rotate the machine off of front wheels 530. FIG. 5B illustrates the irradiator assembly tilted at angle 'C' at point 535 onto the rear wheels.

FIG. 5C is a rear side view illustrating the rear caster wheel arrangement in accordance with one aspect of the present design. The present design's rear wheel configuration may provide a highly maneuverable apparatus when tilted off front wheels as shown in FIG. 5B. Rear caster wheels 550 may allow the irradiator module to be directed in left and right sideways movements indicated by arrow 'D' at point 555.

Transverse/Omnidirectional Wheels

Figure 6A:
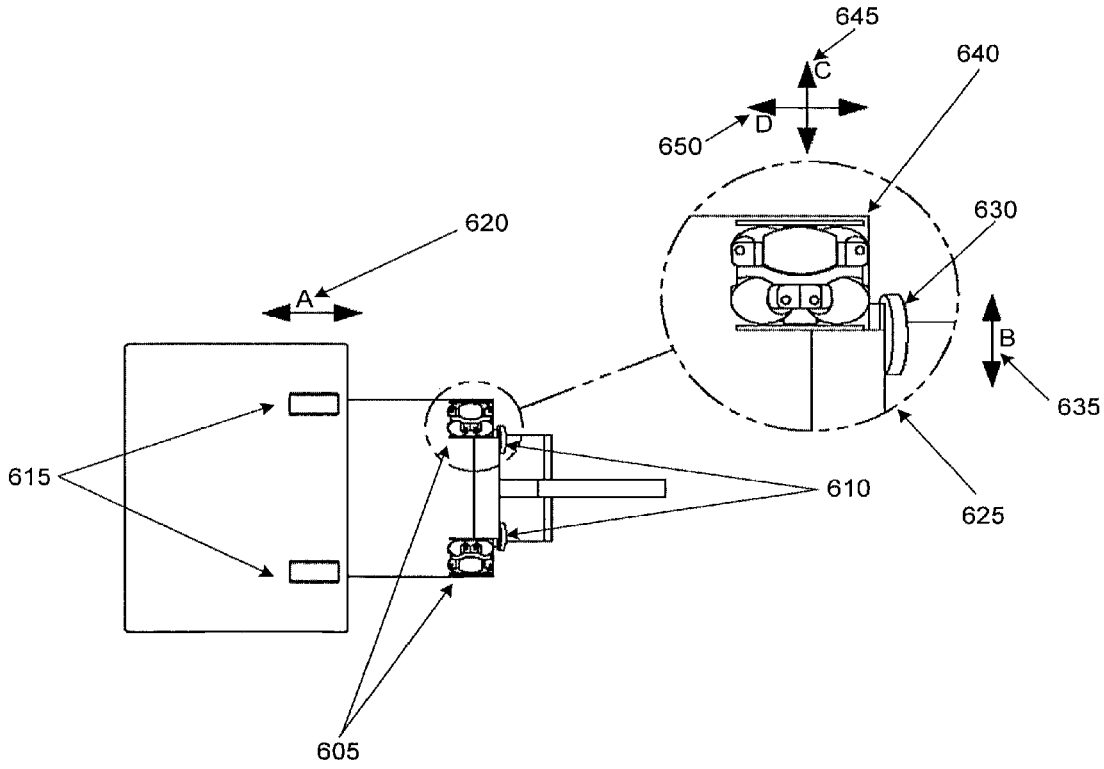
FIG. 6A shows a bottom view illustrating a rear transverse wheel arrangement.

FIG. 6A is a bottom view illustrating a rear transverse wheel arrangement in accordance with one aspect of the present design. In this alternate embodiment, the present design may include a pair of rear omnidirectional wheels 605 and a pair of transversely mounted unidirectional wheels 610 mounted at the rear of the irradiator assembly perpendicular to front wheels 615. The transversely mounted rear wheel arrangement in combination with the rear omnidirectional wheels may allow for steering and execution of limited sideways movement. Front wheels 615 may allow for movement in a straight line indicated by arrow 'A' at point 620, as previously disclosed. FIG. 6A illustrates an expanded view of the present design rear wheel arrangement at point 625. Transverse wheel 630, when engaged by the operator tilting the irradiator assembly, may allow for left-to-right or right-to-left movements indicated by arrow 'B' at point 635. Rear omnidirectional wheel 640 may allow for steering left, right, and sideways movements indicated by arrow 'C' at point 645 and may allow for forward and backward movement indicated by arrow 'D' at point 650.

Figures 6B, 6C:
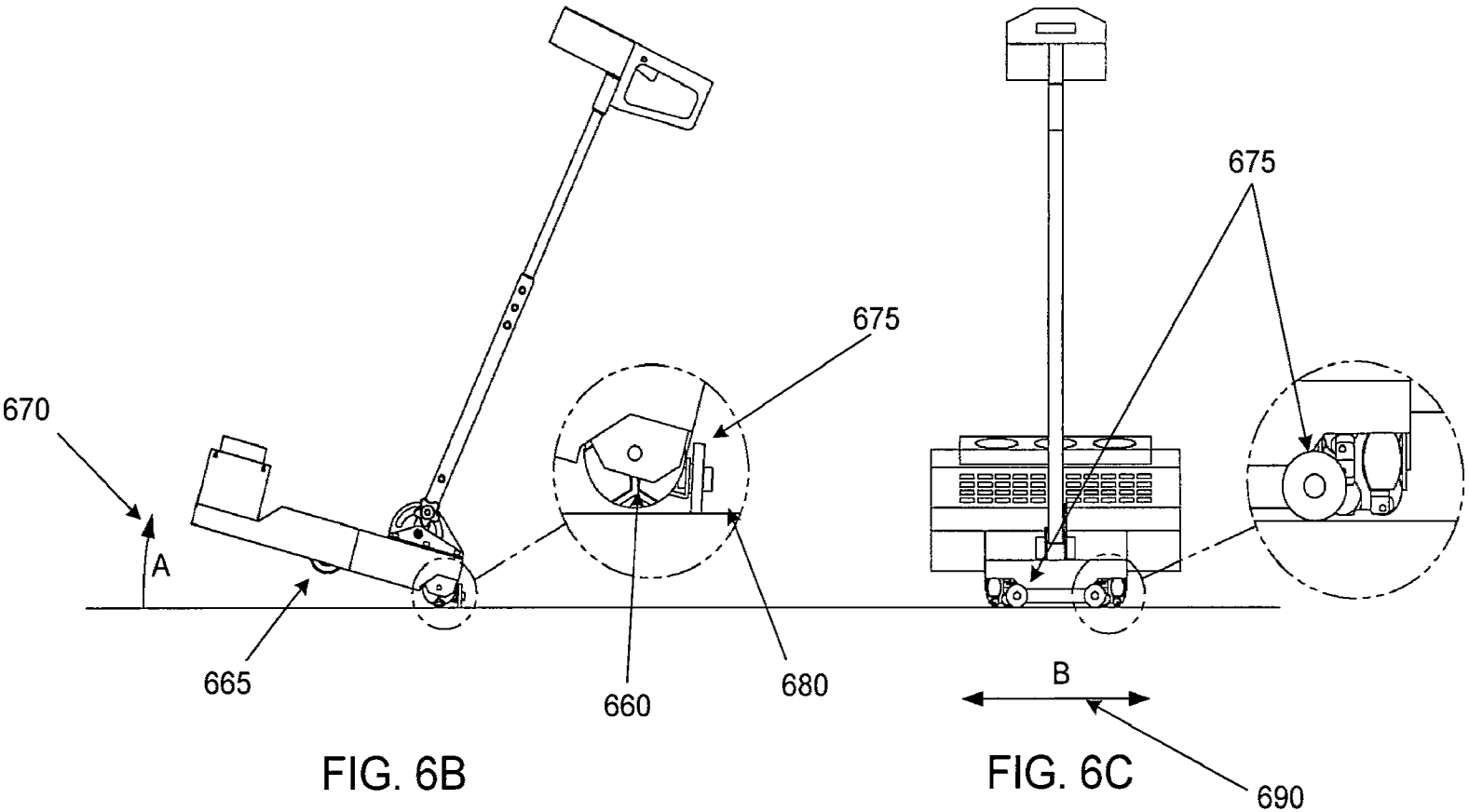
FIG. 6B is a side view illustrating an irradiator assembly rotating about a horizontal axis on the rear omnidirectional wheel arrangement.
FIG. 6C is a rear side view illustrating the rear omnidirectional and transversely mounted rear wheel arrangement.

FIG. 6B is a side view illustrating an irradiator assembly rotating about a horizontal axis on the rear omnidirectional wheel arrangement accordance with one aspect of the present design. In addition to sideways movements, rear omnidirectional wheels 660 may allow the operator to tilt or rotate the machine off of front wheels 665. FIG. 6B illustrates the irradiator assembly tilted at angle 'A' at point 670 onto the rear omnidirectional wheels. Tilting the apparatus in this manner may engage the rear transversely mounted wheels 675 with floor surface 680. When the front wheels and omnidirectional wheels are not in contact with the floor surface, the apparatus may enable sideways movement riding on the transversely mounted wheels.

FIG. 6C is a rear side view illustrating the rear omnidirectional and transversely mounted rear wheel arrangement in accordance with one aspect of the present design. The present design's rear wheel configuration may provide a highly maneuverable apparatus when tilted off the front wheels as shown in FIG. 6B. Transversely mounted wheels 675 may allow the irradiator module to be directed in left and right sideways movements indicated by arrow 'B' at point 690.

The two omnidirectional rear wheels in combination with the set of transversely mounted wheels may be mounted on a bracket at the rear of the machine. The transversely mounted wheels may come into contact with the ground when the machine is tilted at an angle of approximately 10 degrees backwards. At an angle of 10 degrees or more, the irradiator assembly may be pushed sideways to allow curing along walls and edges. Although the omnidirectional wheels will allow for sideways movement, which is ideally suited for steering purposes, they are not freewheeling enough when the machine is pushed sideways.

While two omnidirectional wheels are disclosed herein, it should be noted that a different number, such as four, omnidirectional wheels may be employed, replacing the 230A and 230B with omnidirectional wheels, thus enabling and simplifying further directional changes. Use of additional omnidirectional wheels can be particularly advantageous in small spaces.

Curing Inclines

Figure 7:
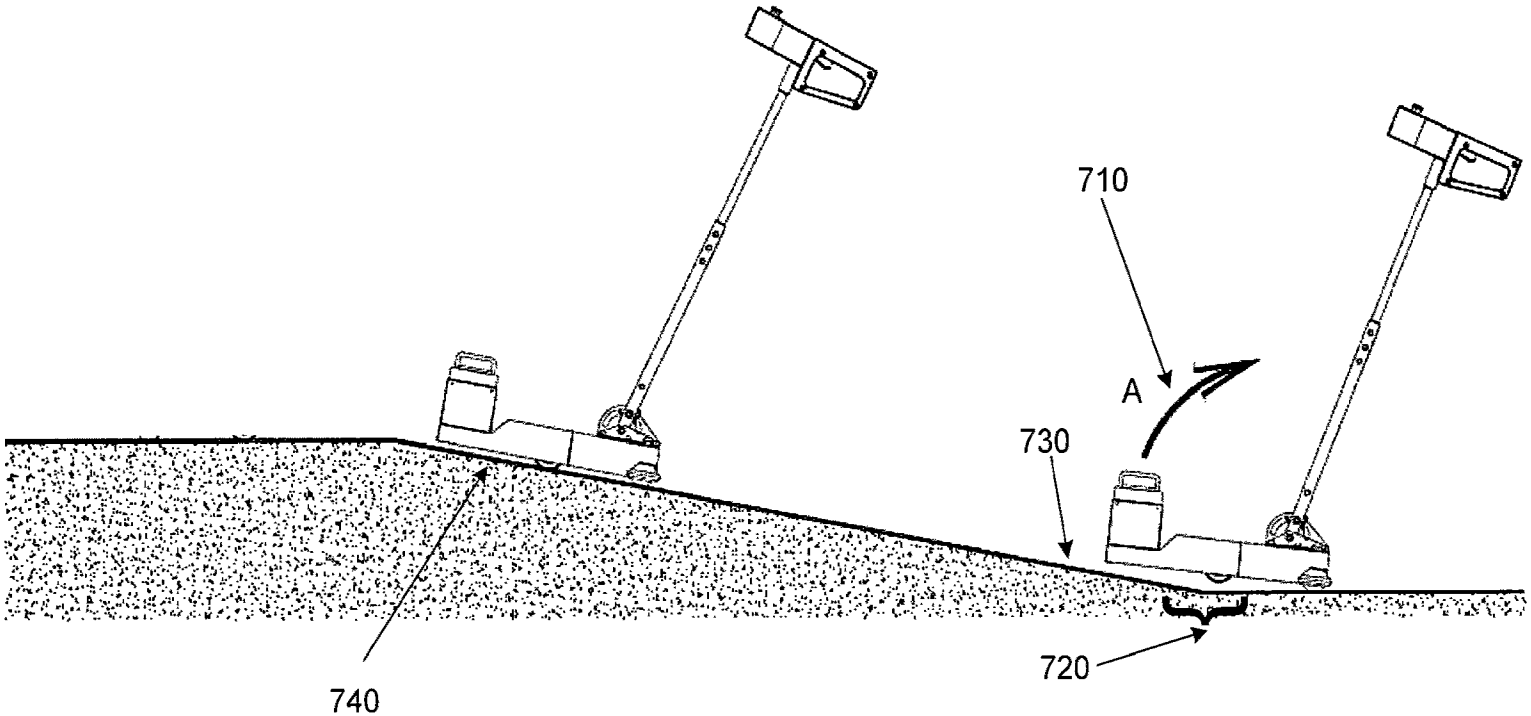
FIG. 7 is a side view of floor curing machine operation over an inclined floor.

FIG. 7 is a side view illustrating the floor curing machine operation over an inclined floor in accordance with one aspect of the present design. The floor curing apparatus may enable the operator to negotiate transitions onto steep inclines by tilting the apparatus backwards onto the rear casters.

The apparatus may be tilted, shown by arrow 'A' at point 710, at a small inclined angle while transitioning onto steep floor surface incline 720. After making the transition, the operator may allow the front wheels to regain contact with the floor surface and begin curing inclined floor surface 740. The apparatus may be tilted at an inclined angle in a manner and orientation sufficient to prevent the skirt, or any other irradiator assembly component from contacting floor surface 730. In addition, the apparatus may prevent skirt contact when transitioning over other obstacles such as door thresholds, gratings, and the like.

Pistol Handle Grip and Telescoping Handlebar

Figure 8A:
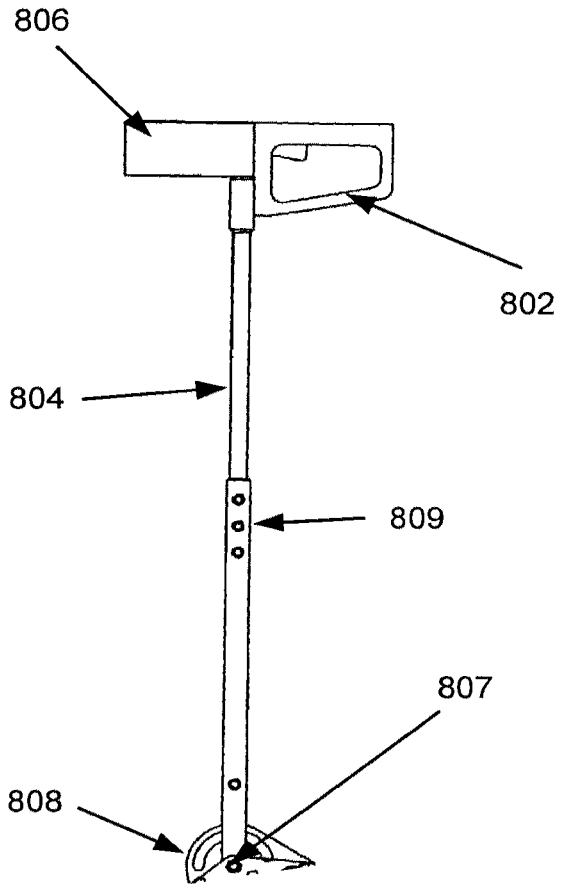
FIG. 8A is a side view illustrating a pistol handle grip affixed to a telescoping handlebar for a floor curing apparatus.

FIG. 8A is a side view illustrating a pistol handle grip affixed to a control console assembly attached to a telescoping handlebar for a floor curing apparatus in accordance with one aspect of the present design. Pistol handle grip 802 may be constructed from nonconductive materials, such as neoprene or silicon rubber, ABS plastic, and so forth for insulating the operator. Pistol handle grip 802 and one end of telescoping handlebar 804 may be attached to control console assembly 806 as shown in FIG. 8A. The other end of telescoping handlebar 804 may be attached to the irradiator assembly at point 807 using swivel junction 808. The height of the telescoping handlebar may be adjusted using a pin arrangement and multiple locating holes at point 809.

Figure 8B:
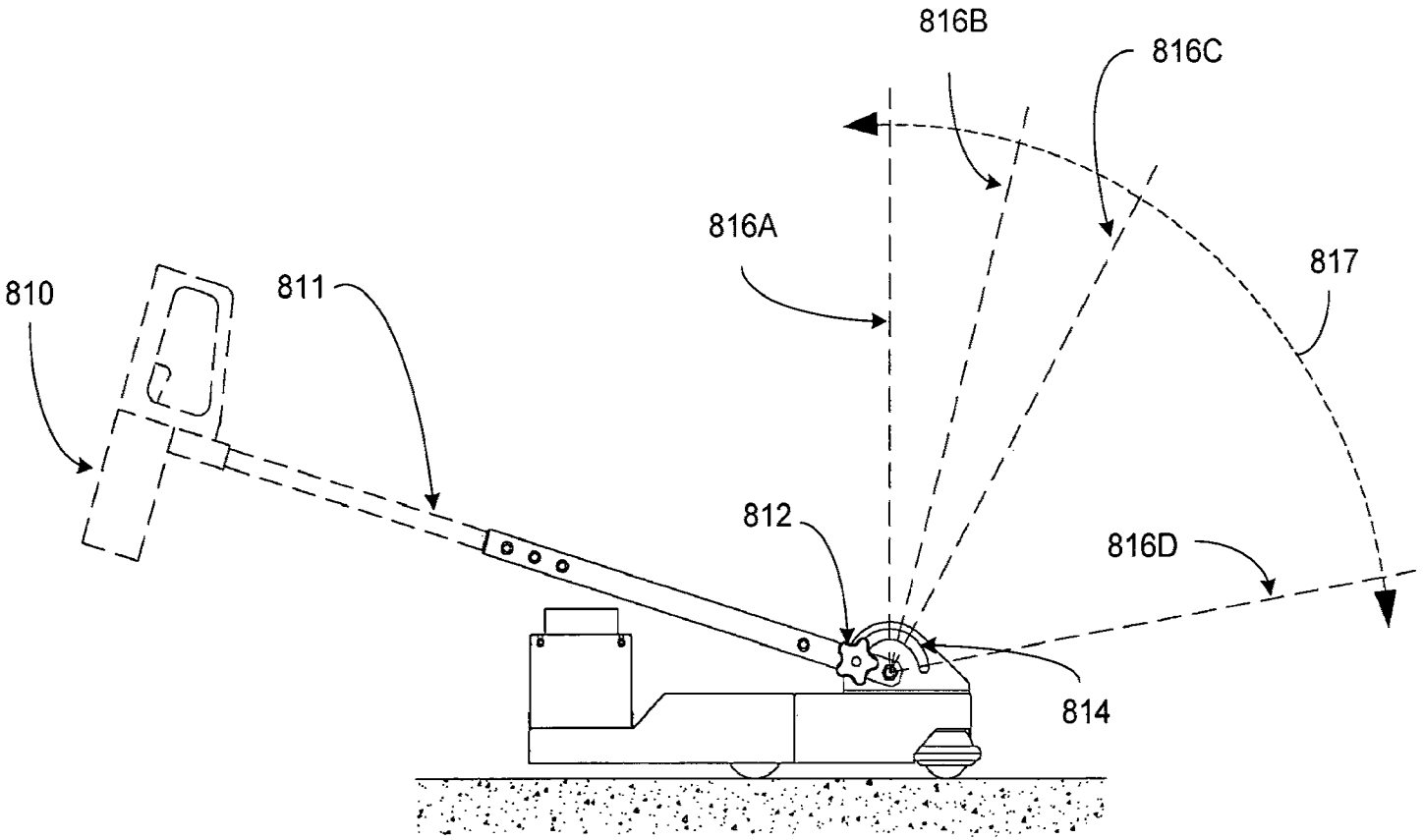
FIG. 8B illustrates the handlebars in a storage and transportation configuration.

Referring to FIG. 8B, the angle of the telescoping handlebar may be adjusted to suit the operator. Control console assembly 810 and telescoping handlebar 811 may connect to the floor curing apparatus using angle adjustment knob 812 within semicircular slot 814. In this arrangement the present design may afford multiple handlebar positions during operational use. FIG. 8B illustrates the handlebars in a storage and transportation configuration. The floor curing apparatus handlebar may be locked in place using angle adjustment knob 812. Four locking positions are shown at points 816A-816D, but as may be appreciated different angles may be employed around the semicircle 817.

Rotating rotating handlebar 811 through this range of motion to, for example, point 816D may facilitate operation when curing underneath overhanging room elements, such as wall hung cabinets, low clearance machinery, underneath stairways, and other restricted spaces.

Control console assembly 810, illustrated in FIG. 8B, may include electronic devices, controls and indication displays, each facilitating machine operation. For example, electronic devices housed within the console may be configured to govern the operation of the power output. Operation may be governed by the hand lever and switch selections located on the control console assembly, where pistol handle grip 802 may be operated by the user for control the shutter device (refer to FIG. 8A) by squeezing the trigger lever against the grip.

There is thus provided a floor curing apparatus including a housing, an ultraviolet lamp, and a rear swivel wheel arrangement including a pair of freewheeling rear omnidirectional or ball caster wheels configured to rotate or pivot around either the left rear swivel wheel or the right rear swivel wheel to facilitate movement of the floor curing machine when operated along side or against a wall, surface edge, or other room transitions while operating at a constant speed. The rear wheels are a freewheeling omnidirectional design and configured to facilitate movement of the floor curing machine when operated along side or against a wall, surface edge, or other room transitions while operating at a constant speed.

The wheel driven frame is a fixed configuration where the vertical height of the ultraviolet irradiator maintains a constant distance between the ultraviolet lamp and the floor surface at all times. The floor curing apparatus also includes a shutter device, a linear actuator configured to drive a support element in a direction away from the ultraviolet lamp, where the support element is affixed to a plurality of guide blocks configured to draw the shutter device away from the ultraviolet lamp.

The present design includes a changeable irradiation profile using interchangeable reflectors/reflector assemblies to provide a desirable irradiation pattern on the floor below.

The design presented herein and the specific aspects illustrated are meant not to be limiting, but may include alternate components while still incorporating the teachings and benefits of the invention, namely a portable floor curing apparatus exhibiting the beneficial characteristics described herein. While the invention has thus been described in connection with specific embodiments thereof, it will be understood that the invention is capable of further modification. This application is intended to cover any variations, uses or adaptations of the invention following, in general, the principles of the invention, and including such departures from the present disclosure as come within known and customary practice within the art to which the invention pertains.

What is claimed is:

1. A floor curing apparatus comprising:

a housing comprising:

an interchangeable reflector assembly; and a shutter assembly comprising a shutter retractable along a plurality of rails; and a plurality of wheels oriented at the bottom of the housing;

wherein the interchangeable reflector assembly comprises an ultraviolet lamp and a reflector configured to maintain a fixed distance from the floor surface, and further wherein the reflector is configured to direct a predetermined light projection pattern toward a photo-sensitive sealant when different reflectors are employed.

2. The floor curing apparatus of claim 1, wherein the reflector comprises a manually installed reflector, and further wherein the predetermined light projection pattern is configured by installing a reflector comprising one from a group consisting of a focused reflector, a flood reflector, and a cross-focused projection pattern reflector.

3. The floor curing apparatus of claim 1, wherein the shutter is selectively moveable to expose the ultraviolet lamp to a surface upon which the floor curing apparatus operates.

4. The floor curing apparatus of claim 1, wherein the plurality of wheels comprise a left front wheel and a right front wheel and a plurality of omnidirectional rear wheels.

5. The floor curing apparatus of claim 1, wherein the plurality of wheels comprise two ball caster wheels positioned at each rear corner of the irradiator assembly configured to facilitate sideways movements of the floor curing apparatus.

6. The floor curing apparatus of claim 1, wherein the plurality of wheels comprise freewheeling omnidirectional rear wheels comprising a transversely mounted wheel and a swivel wheel positioned at each rear corner of the irradiator assembly configured to facilitate sideways movement.

7. The floor curing apparatus of claim 1, further comprising an operator control panel disposed above the axle assembly on an adjustable angle telescoping handlebar configured to be rotationally repositioned and locked using an angle adjustment knob and semicircular slot.

8. The floor curing apparatus of claim 1, further comprising a telescoping handlebar operator control panel disposed on an adjustable angle handlebar configured to be rotationally repositioned and locked using an angle adjustment knob and semicircular slot.

9. A floor curing apparatus comprising:

an ultraviolet lamp;

a replaceable reflector configured to direct light energy transmitted from the ultraviolet lamp, the replaceable reflector comprising one of a plurality of interchangeable reflectors;

a shutter mechanism configured to selectively move a shutter to expose the ultraviolet lamp and the reflector toward a surface upon which the floor curing apparatus operates; and a plurality of wheels;

wherein the ultraviolet lamp and the reflector height from the floor surface are maintained at a predetermined distance above the surface, and further wherein the plurality of interchangeable reflectors provide varying transmission characteristics.

10. The floor curing apparatus of claim 9, wherein the replaceable reflector comprises a manually installable reflector configured to form a desired light energy projection pattern toward the surface.

11. The floor curing apparatus of claim 10, wherein the plurality of interchangeable reflectors comprises one from a set consisting of a focused reflector, a flood reflector, and a cross-focused projection pattern reflector.

12. The floor curing apparatus of claim 9, further comprising a linear actuator configured to drive an axle in a direction away from the ultraviolet lamp, the axle affixed to a plurality of guide blocks configured to slide on ceramic-coated shafts draw the shutter device away from the ultraviolet lamp.

13. The floor curing apparatus of claim 9, further comprising an axle assembly comprising a left front unidirectional wheel and a right front unidirectional wheel.

14. The floor curing apparatus of claim 9, wherein the plurality of wheels comprise freewheeling rear wheels comprising ball caster wheels configured to facilitate sideways movements.

15. The floor curing apparatus of claim 9, wherein the plurality of wheels comprise freewheeling rear wheels comprising a transversely mounted wheel and an omnidirectional swivel wheel configured to facilitate sideways movements.

16. The floor curing apparatus of claim 9, further comprising an operator control panel disposed above the axle assembly on an adjustable angle telescoping handlebar configured to be rotationally repositioned and locked using an angle adjustment knob and semicircular slot.

17. The floor curing apparatus of claim 9, further comprising a telescoping handlebar operator control panel disposed above the drive assembly on an adjustable angle handlebar configured to be rotationally repositioned and locked using an angle adjustment knob and semicircular slot.

18. A floor curing apparatus comprising:

a housing containing:

an ultraviolet lamp;

a replaceable reflector configured to direct light energy transmitted from the ultraviolet lamp, the replaceable reflector comprising one of a plurality of interchangeable reflectors; and a shutter mechanism configured to selectively move a shutter to expose the ultraviolet lamp and the reflector toward a surface upon which the floor curing apparatus operates; and a plurality of wheels affixed to the housing and configured to provide omnidirectional movement of the floor curing apparatus;

wherein the plurality of interchangeable reflectors provide varying transmission characteristics.

* * * * *